US006373440B2

(12) United States Patent
Apostolos

(10) Patent No.: US 6,373,440 B2
(45) **Date of Patent: *Apr. 16, 2002**

(54) MULTI-LAYER, WIDEBAND MEANDER LINE LOADED ANTENNA

(75) Inventor: John T. Apostolos, Merrimack, NH (US)

(73) Assignee: Bae Systems Information and Electronic Systems Integration, Inc., Nashua, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/870,970

(22) Filed: May 31, 2001

Related U.S. Application Data

(60) Provisional application No. 60/208,193, filed on May 31, 2000.

(51) Int. Cl.[7] ..... H01Q 11/14

(52) U.S. Cl. ..... 343/744; 343/745

(58) Field of Search ..... 343/895, 744, 343/745, 741, 742, 748, 700 MS, 866, 867; H01Q 11/14

(56) References Cited

U.S. PATENT DOCUMENTS

| | | | | |
|---|---|---|---|---|
| 3,736,534 A | | 5/1973 | Chaffee | |
| 3,754,271 A | | 8/1973 | Epis | |
| 3,823,403 A | | 7/1974 | Walter et al. | |
| 3,849,745 A | | 11/1974 | Schellenberg et al. | |
| 4,257,049 A | | 3/1981 | Kuo | |
| 4,293,858 A | | 10/1981 | Hockham | |
| 4,804,965 A | | 2/1989 | Roederer | |
| 4,903,033 A | | 2/1990 | Tsao et al. | |
| 5,592,185 A | | 1/1997 | Itabashi et al. | |
| 5,754,143 A | | 5/1998 | Warnagiris et al. | |
| 5,767,810 A | * | 6/1998 | Hagiwara et al. | 343/700 MS |
| 5,784,032 A | * | 7/1998 | Johnston et al. | 343/702 |
| 5,790,080 A | | 8/1998 | Apostolos | |
| 6,008,762 A | | 12/1999 | Nghiem | |
| 6,028,564 A | | 2/2000 | Duan et al. | |
| 6,034,637 A | | 3/2000 | McCoy et al. | |
| 6,040,803 A | | 3/2000 | Spall | |
| 6,097,347 A | | 8/2000 | Duan et al. | |

OTHER PUBLICATIONS

PCT International Search Report dated Aug. 14, 2001 of International Application No. PCT/US01/17423 filed May 31, 2001.

* cited by examiner

*Primary Examiner*—Hoanganh Le
(74) *Attorney, Agent, or Firm*—Scott J. Asmus; Vernon C. Maine

(57) ABSTRACT

A meander line loaded antenna (MLA) that utilizes more two or more layers of meander lines to greatly extend the operating frequency range. The antenna of the present invention can achieve an operating frequency range of 100:1, unlike antennas of the prior art, which were limited to frequency ranges of approximately 10:1.

17 Claims, 5 Drawing Sheets

MULTI-LAYER, WIDEBAND MEANDER LINE LOADED ANTENNA

CROSS REFERENCE TO RELATED APPLICATION

Applicant hereby claims the priority benefits in accordance with the provisions of 35 U.S.C. §119, basing said claim on United States Provisional Patent Application Serial No. 60/208,193, filed May 31, 2000.

FIELD OF THE INVENTION

The invention pertains to varied impedance transmission line antennas, more commonly known as meander line loaded antennas (MLA) and, more particularly, to multi-layer MLA antennas.

BACKGROUND OF THE INVENTION

In the past, efficient antennas have typically required structures with minimum dimensions on the order of a quarter wavelength of the radiating frequency. These dimensions allowed the antennas to be excited easily, to be operated at or near a resonance in order to limit dissipating resistive energy losses, and to maximize the transmitted energy. These antennas tended to be large in size at the resonant wavelength. Furthermore, as frequency decreased, the antenna dimensions increased in proportion.

In order to address some of the shortcomings of traditional antenna design and functionality, the meander line loaded antenna (MLA) was developed. One MLA is disclosed in U.S. Pat. No. 5,790,080, entitled MEANDER LINE LOADED ANTENNA. The MLA antenna consists of two vertical conductors and a horizontal conductor. The vertical and horizontal conductors are separated by gaps. The MLA antenna comprises meander lines that are connected between the vertical and horizontal conductors at the gaps.

The meander lines are designed to adjust the electrical length of the antenna. In addition, the design of the meander lines provide a slow wave structure that permits lengths to be quickly switched into or out of the circuit. This changes the effective electrical length of the antenna with little electrical loss. This switching is possible because the active switching devices are located in the high impedance sections of the meander line. This keeps the current through the switching section low, resulting in very low dissipation losses and high antenna efficiency.

The basic antenna described in the aforesaid patent can be operated in a loop mode that provides a "figure eight" coverage pattern. Horizontal polarization, loop mode, is obtained when the antenna is operated at a frequency that is a multiple of the full wavelength frequency that includes the electrical length of the entire line, comprising the meander lines. The antenna can also be operated in a vertically polarized, monopole mode, by adjusting the electrical length to an odd multiple of a half wavelength at the operating a frequency. The meander lines can be tuned using electrical or mechanical switches to change the mode of operation at a given frequency or to switch the frequency when operating in a given mode.

The invention of the meander line loaded antenna allowed the physical antenna dimensions to be reduced significantly, for an electrical length that is a multiple of a quarter wavelength of the operating frequency. Antennas and radiating structures that use this design operate in a region where the limitation on their fundamental performance is governed by the Chu-Harrington relation: Efficiency=$FV_2Q$
where:

Q=Quality Factor $V_2$=Volume of the structure in cubic wavelengths

F=Geometric Form Factor (F=64 for a cube or a sphere)

Meander line loaded antennas achieve the efficiency limit of the Chu-Harrington relation while allowing the antenna size to be much less than a wavelength at the frequency of operation. Height reductions of 10 to 1 can be achieved over quarter wave monopole antennas, while achieving comparable gain.

Existing MLAs are narrow band antennas. The switchable meander line allows the antennas to cover wider frequency bands. However, the instantaneous bandwidth is always narrow. For many military and commercial applications, where signals can appear unexpectedly over a wide frequency range, existing MLA antennas are not satisfactory.

DISCUSSION OF THE RELATED ART

The aforementioned U.S. Pat. No. 5,790,080 describes an antenna that includes one or more conductive elements that act as radiating antenna elements and a slow wave meander line that couples electrical signals between the conductive elements. The meander line has an effective electrical length, which affects the electrical length and operating characteristics of the antenna. The electrical length and operating mode of the antenna are readily controlled.

U.S. Pat. No. 6,034,637 for DOUBLE RESONANT WIDEBAND PATCH ANTENNA AND METHOD OF FORMING SAME, describes a double resonant wideband patch antenna that includes a planar resonator forming a substantially trapezoidal shape. The antenna has a non-parallel edge for providing a wide bandwidth. A feed line extends parallel to the non-parallel edge to provide coupling while a ground plane extends beneath the planar resonator for increasing radiation efficiency.

U.S. Pat. No. 6,008,762 for FOLDED QUARTER WAVE PATCH ANTENNA, describes a folded quarter-wave patch antenna, which includes a conductor plate having first and second spaced apart arms. A ground plane is separated from the conductor plate by a dielectric substrate, and is approximately parallel to the conductor plate. The ground plane is electrically connected to the first arm, at a distal end. A signal unit is also electrically coupled to the first arm. The signal unit transmits and/or receives signals having a selected frequency band. The folded quarter-wave patch antenna also acts as a dual frequency band antenna. In dual frequency band operation, the signal unit provides the antenna with a first signal of a first frequency band and a second signal of a second frequency band.

One of the differences between the antenna of the present invention and that of the prior art is the use of multiple meander lines. These meander lines can be switched into and out of the antenna circuit as needed in order to tune the antenna for operation over a frequency range of 100:1.

SUMMARY OF THE INVENTION

In accordance with the present invention there is provided a meander line loaded antenna (MLA), which utilizes more than one set of meander lines to greatly extend the operating frequency range. The antenna of the present invention can achieve an operating frequency range of 100:1, unlike antennas of the prior art, which were limited to frequency ranges of approximately 10:1.

It is, therefore, an object of the invention to provide a meander line loaded antenna incorporating multiple sets of meander lines. It is another object of the invention to provide an MLA incorporating multiple sets of meander lines that can be selectively switched into and out of the circuit in order to tune the MLA. While the instantaneous bandwidth remains relatively narrow, the narrow band of operation can be switched over a broad frequency range and thus provide wideband coverage.

An object of the invention is a wideband meander line loaded antenna, comprising a ground plane, and a pair of substantially vertical radiating surface elements disposed substantially parallel to one another and perpendicular to the ground plane. There is a horizontal radiating surface element substantially parallel to the ground plane with one or more substantially horizontal plates disposed between the horizontal radiating surface element and the ground plane. A plurality of meander line elements are attached to the horizontal radiating surface element and the two or more horizontal plates. Finally, there are a plurality of vertical connections connecting each of the meander line elements to each other and from the meander line elements to the horizontal radiating surface element and to the vertical radiating surface elements. One embodiment includes vertical lines that are non-radiating microstrip transmission lines.

Another object is a wideband meander line loaded antenna wherein a pair of the meander line elements are attached to each horizontal radiating surface element and the two or more horizontal plates.

An additional object is for a means for switching the meander line elements, wherein the switching means controls a length of the meander line elements. This extends the operating frequency range such that the frequency range= $K^n$, where K is a number between 2 and 10 depending on geometry and the number of sections in a layer, and n is the number of layers.

Yet a further object is a wideband meander line loaded antenna, wherein the horizontal plates and the horizontal radiating surface element are attached to dielectric layers. The vertical radiating surface elements can also attach to the dielectric material to make manufacture and construction simpler.

An object includes a wideband meander line loaded antenna wherein the means for switching are microelectromechanical switches. Other switches are within the scope of the invention and known in the art.

And another object is the wideband meander line loaded antenna, further comprising a shield layer disposed intermediate and adjacent the horizontal radiating surface element and the horizontal plate, wherein the shield layer is electrically connected across a gap to the pair of vertical radiating surface elements. As an example, the shield layer may comprise a solid plate or a meshed structure.

An object of the invention is a meander line loaded antenna having an effective wide bandwidth, comprising a ground plane and a pair of substantially vertical radiating surface elements disposed substantially parallel to one another and juxtaposed to the ground plane. A substantially horizontal radiating surface element is disposed adjacent the pair of vertical radiating surface elements across a gap with a plurality of meander lines connected in series and forming a meander line length between the horizontal radiating surface element and the vertical radiating surface elements across the gap. There are a plurality of connectors connecting each of the meander lines to each other and from the meander lines to the horizontal radiating surface element and to the vertical radiating surface elements. Finally, there is a means for changing the meander line length, wherein the means for changing moves a frequency band of the antenna providing the effective wide bandwidth. One means for changing are meander line switches, and the invention contemplates a microprocessor for controlling the switches.

A final object of the invention is the meander line loaded antenna, wherein the plurality of meander lines comprises a first meander line having first and second distal ends, the first distal end operatively connected to at least one of the vertical radiating surface elements, and a second meander line having a first distal end operatively connected to the second distal end of the first meander line, and having a second distal end operatively connected to a substantially horizontal plate.

Still other objects and advantages of the present invention will become readily apparent to those skilled in this art from the following detailed description, wherein I have shown and described only a preferred embodiment of the invention, simply by way of illustration of the best mode contemplated by me on carrying out my invention. As will be realized, the invention is capable of other and different embodiments, and its several details are capable of modifications in various obvious respects, all without departing from the invention.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

This present invention provides an enhancement to an MLA, which extends its operating bandwidth. The enhancement is accomplished by stacking multiple MLA elements on top of one another. One of the features of the present invention comprises the nesting of meander line antennas in order to extend the operating frequency range.

Figure 1:
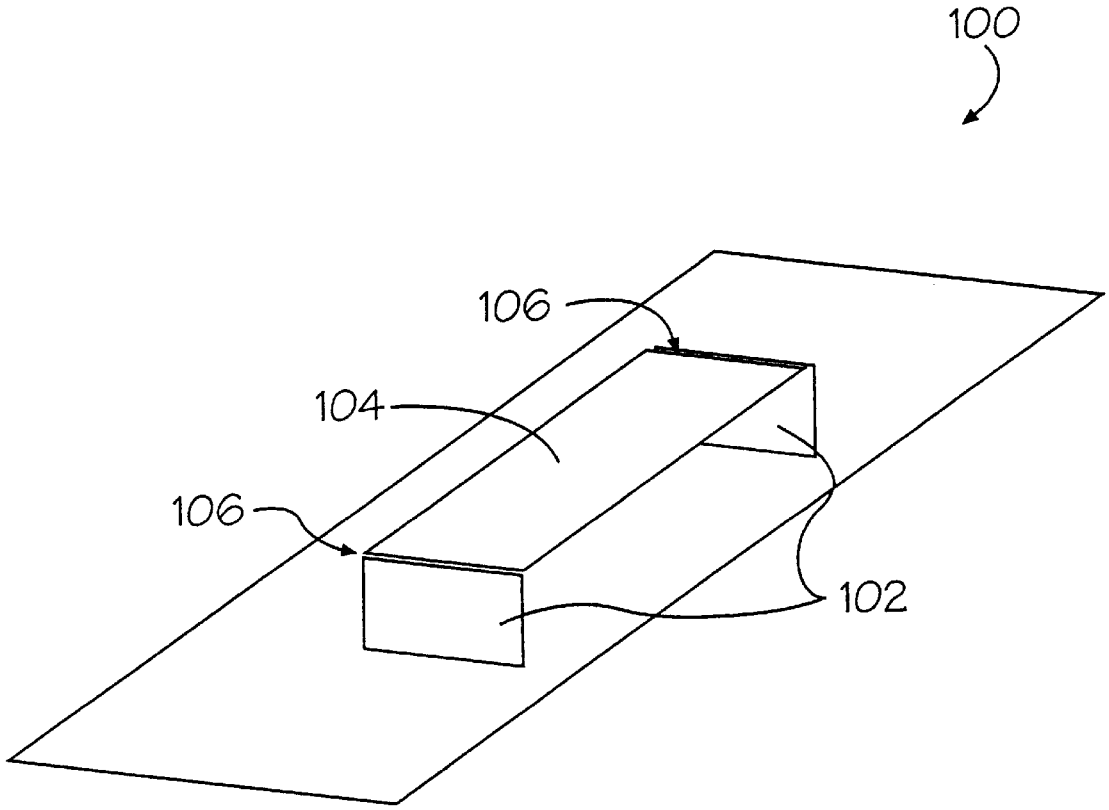
Prior Art Figure 1
FIG. 1 illustrates a schematic, perspective view of a meander line loaded antenna of the prior art.
Figure 2:
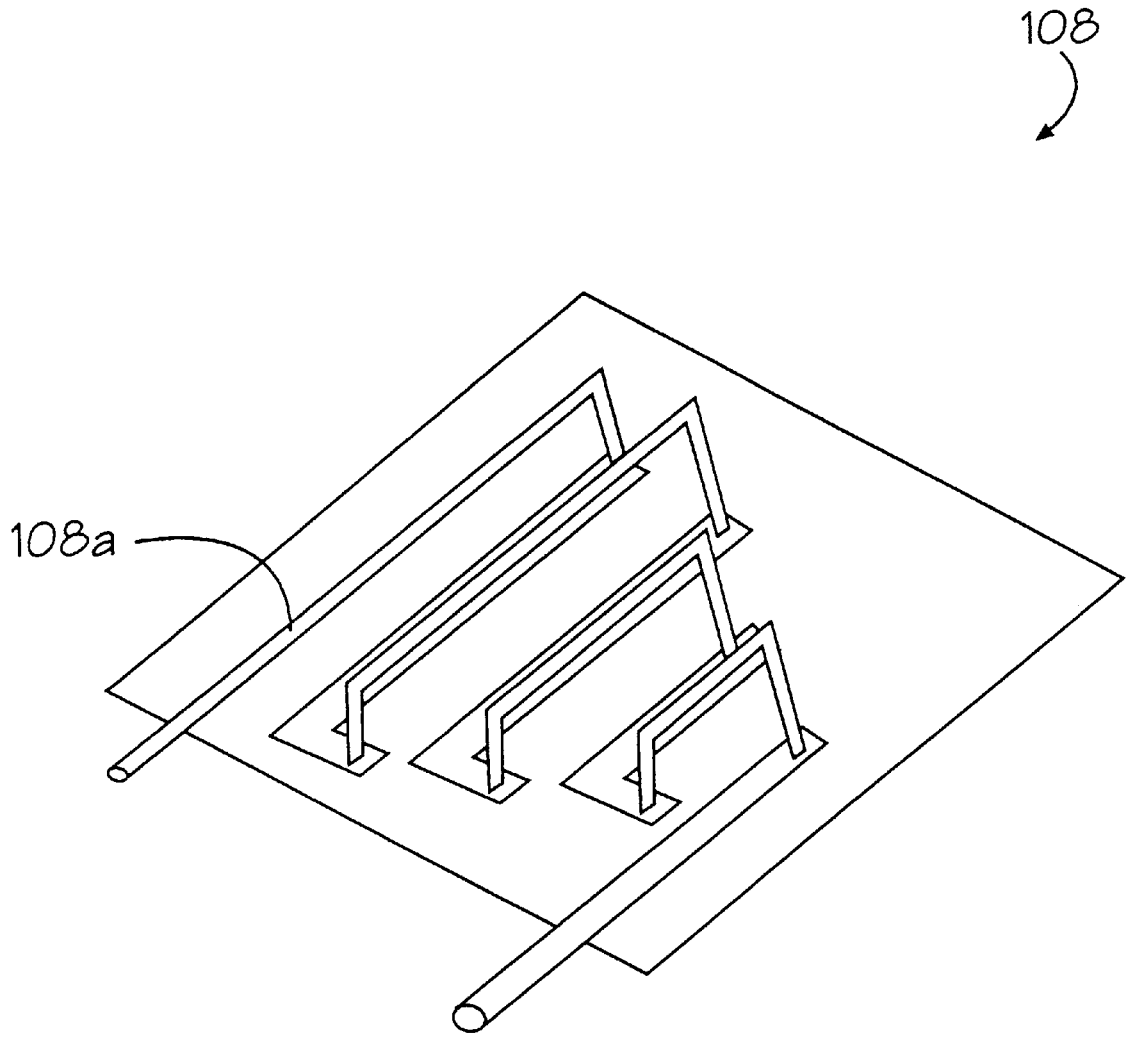
FIG. 2 depicts a schematic, perspective view of a meander line used as an element coupler in the meander line loop antenna of FIG. 1.
Figure 3:
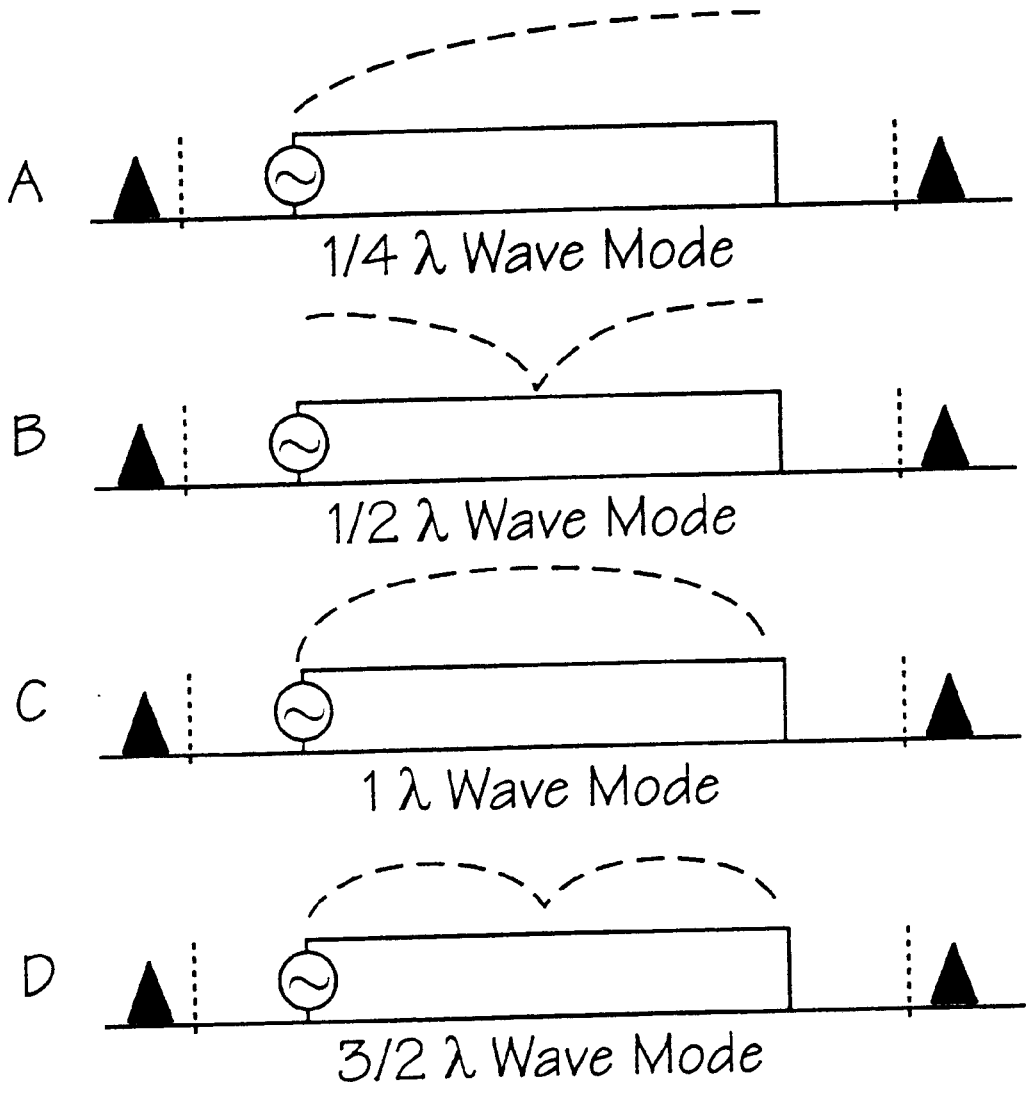
FIG. 3, consisting of a series of diagrammatic views 3A through 3D, depicts four operating modes of the antenna.

FIG. 1 illustrates the prior art meander line loaded structure 100 described in more detail is U.S. Pat. No. 5,790,080. A pair of opposing side units 102 are connected to a ground plane 105 and extend substantially orthogonal from the ground plane 105. A horizontal top cover 104 extends between the side pieces 102, but does not come in direct contact with the side units 102. Instead, there are gaps 106 separating the side pieces 102 from the top cover 104. A meander line loaded element 108, such as the one depicted in FIG. 2 is placed on the inner corners of the structure 100 such that the meander line 108 resides near the gap on either the horizontal cover 104 or the side pieces 102.

In the preferred embodiment, the meander line loaded structure 108 provides a switching means to change the electrical length of the line and thereby effect the properties of the structure 100. As explained in more detail in the prior art, the switching enables the structure to operate in loop mode or monopole mode by altering the electrical length and hence the wavelengths as shown in FIGS. 3A–D.

Figure 4:
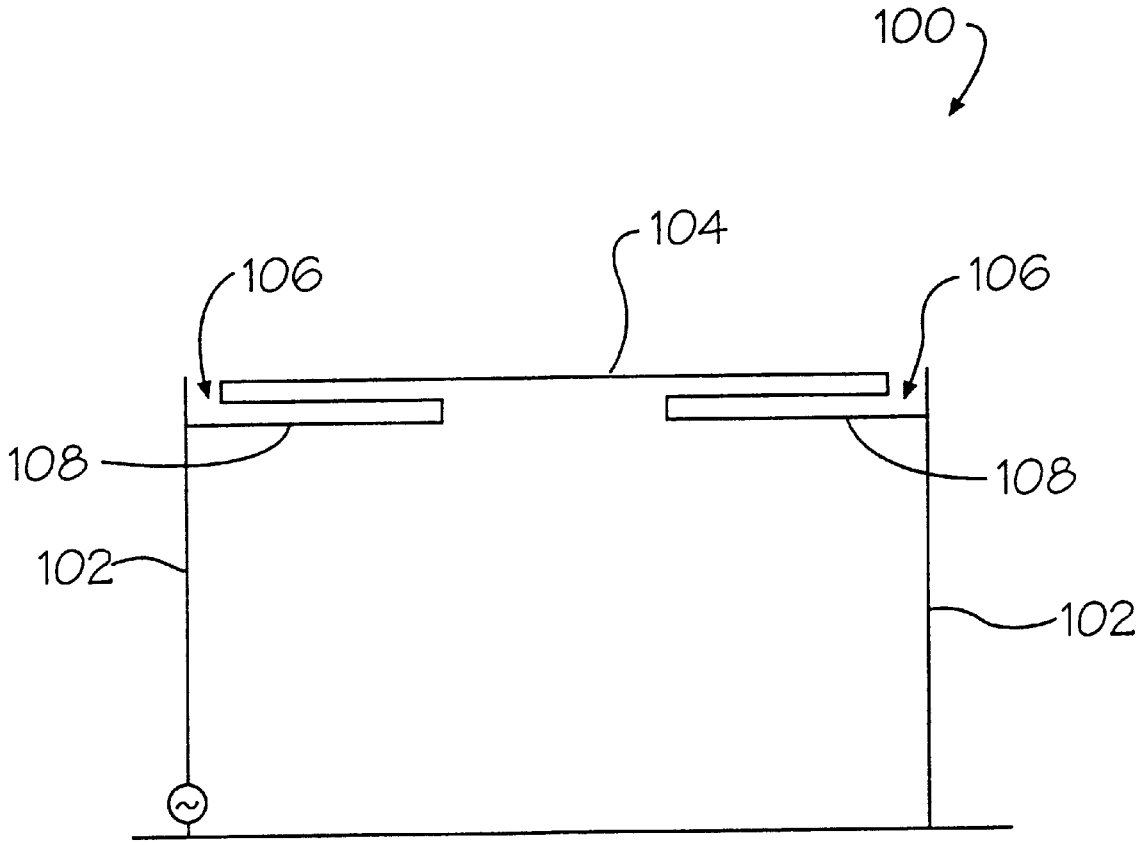
FIG. 4 shows a schematic, cross-sectional view of an MLA having plural meander lines.

Referring now to FIG. 4, there is shown a schematic, cross-sectional view of a conventional MLA element 100. Two vertical radiating surfaces 102 are separated from a horizontal surface 104 by gaps 106. A pair of meander lines 108 are connected between vertical surfaces 102 and horizontal surface 104, and are used to tune the MLA element 100. Meander lines 108 may be mounted on either the vertical surfaces 102 or on the horizontal surface 104. The bandwidth of a MLA element constructed in this manner is typically in the range of 10:1. This operating bandwidth is insufficient for certain antenna applications.

Figure 5:
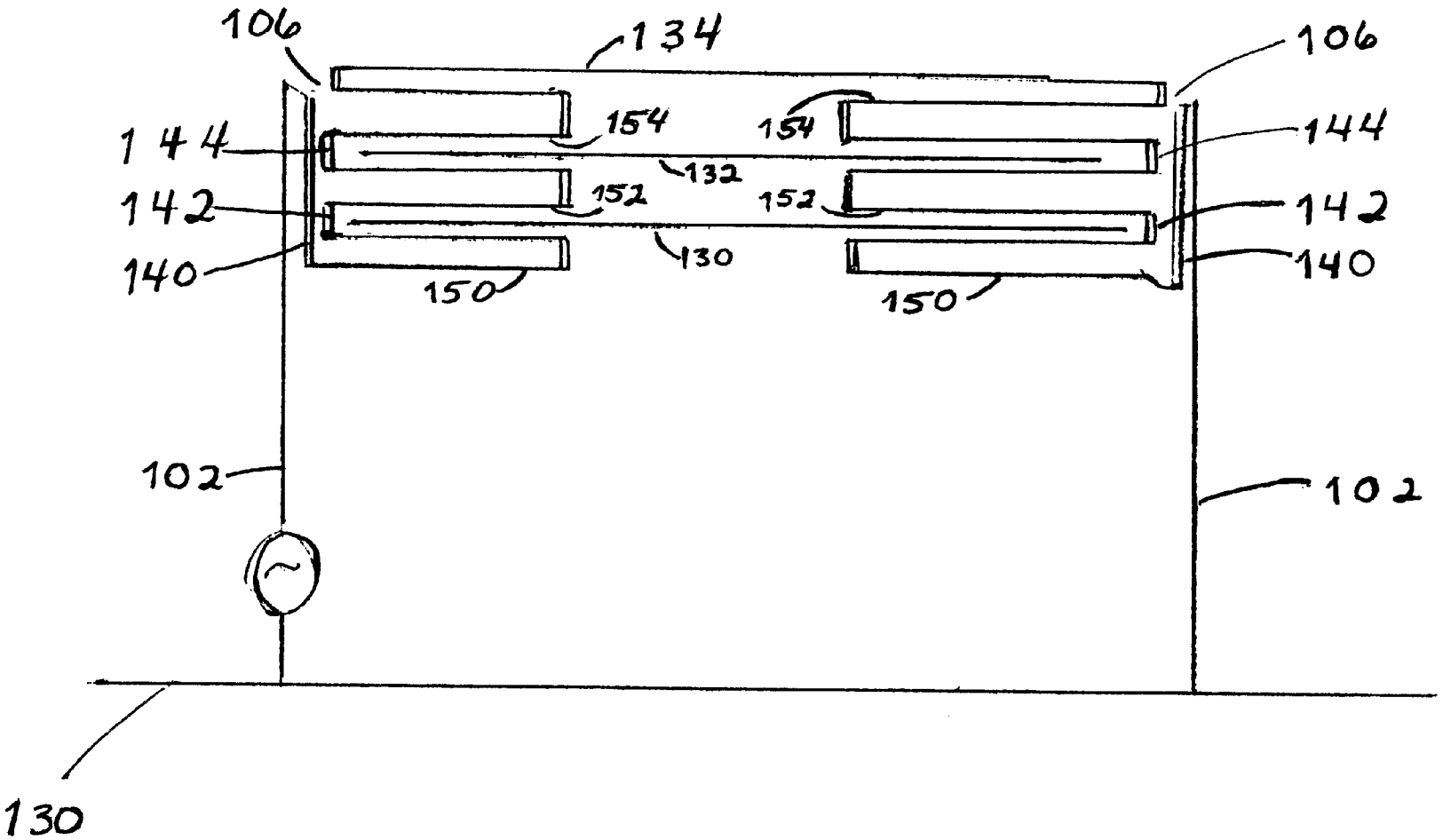
FIG. 5 is a schematic, cross-sectional view of a multilayered MLA having plural meander lines and a isolated vertical connecting lines.

To increase the bandwidth, multiple horizontal surfaces with respective meander lines are incorporated. Referring to FIG. 5, a schematic, cross-sectional view of the wideband MLA element 120 is illustrated.

As described in the prior art, vertical radiating surfaces 102 are connected to the ground plate 130. The horizontal surfaces include the radiating surface 134 that is series connected to a plurality of horizontal plates, all with associated meander lines. The multiple horizontal plates are substantially parallel to the ground plane and each other, and oriented between the horizontal radiating surface and the ground plane.

In the disclosed embodiment, there are two horizontal plates 130 and 132. Each of these plates 130, 132 has respective meander lines 150, 152 associated with the plate. There is also an additional meander line 154 associated with the horizontal radiating surface 134. Switching of these multiple meander lines is done using the methods disclosed in the prior art.

It is obvious to one skilled in the art that any reasonable number of plates and meander lines can be incorporated. One means of fabrication is to attach the meander line elements to the underside of each horizontal plate. The plates and meander lines can be attached to dielectric layers to maintain spacing and orientation and form a sandwiched configuration. Production models can be fabricated as an integral unit.

The lowest meander line element 150 is connected to the vertical surfaces 102 via the vertical connecting line 140. The middle horizontal plate 132 with meander line 152 is located above horizontal surface 130 and substantially parallel thereto, and is connected to horizontal surface 130 by vertical connecting line 142. The top plate is the horizontal radiation surface 134 with meander line 154, and is connected by vertical connecting line 144.

In a preferred embodiment vertical connecting lines are non-radiating micro-strip transmission lines that isolate the series connected meander lines 150, 152, 154 with the respective plates 130, 132, 134. Ideally, all of the vertical lines are non-radiating to minimize cross coupling effects.

Alternatively, a shield plate can be interposed between the horizontal surfaces to isolate the plates and reduce cross-coupling. The shield layers can have a center break in order to ensure that no reactive coupling exists between meander lines. The shield may have a solid, perforated, or mesh design, and can be connected to the vertical radiating surfaces. For perforated or mesh shields, the largest hole size must be less than $\lambda 16$ at the highest frequency of operation in order to ensure that there is no significant reactive coupling.

In operation, the manipulation of the meander lines 150, 152, 154 determine the frequency at which each provides an effect. Although the antenna has a relatively narrow bandwidth, the narrow bandwidth is easily controlled to move the bandwidth across a large frequency range, thus effectively creating a wideband device.

The meander lines can have a number of switchable connections to enable a more fine tuned switching operation. At low frequencies, most of the meander line length will be connected, but as the frequency of interest increases, the switching can decrease the meander line lengths. Micro-electromechanical system (MEMS) switches, PIN diodes, etc., are switching devices suitable for miniature RF operation. Resistive losses in the circuit are minimized by respectively placing the switching devices in the high impedance sections of the meander lines where currents are relatively low. The structure can also be designed having the low impedance regions of the meander lines with high conductivity.

One of the applications for the present invention encompasses a microcontroller and a smart switching topology, whereby the antenna provides an effective wide bandwidth. The antenna device senses RF signal and determines the frequency being used and the microprocessor switches the appropriate switches to tune the antenna to the sensed RF signal. Such application is invisible to the user and greatly extends the coverage bandwidth.

It has been observed that the frequency range of a meander line antenna is given by the formula:

$$\text{Frequency Range}=K^n.$$

where: K is a number between 2 and 10 depending on geometry and the number of sections in a layer; n is the number of layers.

In this case, the use of the triple layer of meander lines of the preferred embodiment increases the frequency range of operation to $K^3$.

In operation, at low frequencies all or most of the switched meander lines would be connected. As the frequency increased, the lower meander lines can be shortened by switching as is known in the art. As the frequency increased further, the lowest meander line would be electrically removed by switching and the switching process would continue through the rest of the meander lines.

Since other modifications and changes varied to fit particular operating conditions and environments or designs will be apparent to those skilled in the art, the invention is not considered limited to the examples chosen for purposes of disclosure, and covers changes and modifications which do not constitute departures from the true scope of this invention.

Having thus described the invention, what is desired to be protected by letters patents is presented in the subsequently appended claims.

What is claimed is:

1. A wideband meander line loaded antenna, comprising:

a) a ground plane;

b) a pair of substantially vertical radiating surface elements disposed substantially parallel to one another and perpendicular to said ground plane;

c) a horizontal radiating surface element substantially parallel to said ground plane;

d) one or more substantially horizontal plates disposed between said horizontal radiating surface element and said ground plane;

e) a plurality of meander line elements attached to said horizontal radiating surface element and said one or more horizontal plates; and f) a plurality of vertical lines connecting each of said meander line elements to each other and from said meander line elements to said horizontal radiating surface element and to said vertical radiating surface elements.

2. A wideband meander line loaded antenna according to claim 1, wherein said vertical lines are non-radiating microstrip transmission lines.

3. A wideband meander line loaded antenna according to claim 1, wherein a pair of said meander line elements are attached to each said horizontal radiating surface element and said two or more horizontal plates.

4. A wideband meander line loaded antenna according to claim 1, further comprising a means for switching said meander line elements, wherein said switching means controls a length of said meander line elements.

5. A wideband meander line loaded antenna according to claim 1, wherein an frequency range=$K^n$, where K is a number between 2 and 10 depending on geometry and the number of sections in a meander line element, and n is the number of meander line elements.

6. A wideband meander line loaded antenna according to claim 1, wherein said horizontal plates and said horizontal radiating surface element are attached to dielectric layers.

7. A wideband meander line loaded antenna according to claim 1, wherein said means for switching are microelectromechanical switches.

8. The wideband meander line loaded antenna according to claim 1, further comprising:

a shield layer disposed intermediate and adjacent said horizontal radiating surface element and said horizontal plate, said shield layer being electrically connected across a gap to said pair of vertical radiating surface elements.

9. The wideband meander line loaded antenna according to claim 8, wherein said shield layer comprises a solid plate.

10. The wideband meander line loaded antenna according to claim 8, wherein said shield layer comprises a meshed structure.

11. A meander line loaded antenna having an effective wide bandwidth, comprising:

a) a ground plane;

b) a pair of substantially vertical radiating surface elements disposed substantially parallel to one another and juxtaposed to said ground plane;

c) a substantially horizontal radiating surface element disposed adjacent said pair of vertical radiating surface elements across a gap;

d) a plurality of meander lines connected in series and forming a meander line length between said horizontal radiating surface element and said vertical radiating surface elements across said gap;

d) a plurality of connectors connecting each of said meander lines to each other and from said meander lines to said horizontal radiating surface element and to said vertical radiating surface elements;

e) a means for changing said meander line length, wherein said means for changing moves a frequency band of said antenna providing said effective wide bandwidth.

12. The meander line loaded antenna according to claim 11, wherein said connectors are non-radiating microstrip transmission lines.

13. The meander line loaded antenna according to claim 11, wherein said plurality of meander lines are attached to a corresponding plurality of plates.

14. The meander line loaded antenna according to claim 13, wherein said plates are oriented substantially horizontal between said ground plane and said horizontal radiating surface element.

15. The meander line loaded antenna according to claim 11, wherein said means for changing are meander line switches.

16. The meander line loaded antenna according to claim 15, further comprising a microprocessor for controlling said switches.

17. The meander line loaded antenna according to claim 11, wherein said plurality of meander lines comprises:

a first meander line having first and second distal ends, said first distal end operatively connected to at least one of said vertical radiating surface elements; and a second meander line having a first distal end operatively connected to said second distal end of said first meander line, and having a second distal end operatively connected to said horizontal radiating surface element.

* * * * *